US007926178B2

(12) United States Patent
Thomson et al.

(10) Patent No.: US 7,926,178 B2
(45) Date of Patent: Apr. 19, 2011

(54) METHOD OF FUEL NOZZLE CONSTRUCTION

(75) Inventors: Neal Thomson, West Des Moines, IA (US); Derrick Clausen, Grimes, IA (US); Kevin Groeneveld, Urbandale, IA (US)

(73) Assignee: Delavan Inc, West Des Moines, IA (US)

( * ) Notice: Subject to any disclaimer, the term of this patent is extended or adjusted under 35 U.S.C. 154(b) by 320 days.

(21) Appl. No.: 11/998,584

(22) Filed: Nov. 30, 2007

(65) Prior Publication Data

US 2009/0140073 A1 Jun. 4, 2009

(51) Int. Cl.

| | |
|---|---|
| ***B21D 51/16*** | (2006.01) |
| ***B23P 11/02*** | (2006.01) |
| ***B23P 17/00*** | (2006.01) |
| ***B23K 9/00*** | (2006.01) |

(52) U.S. Cl. ..... 29/890.142; 29/447; 29/890.09; 29/890.131; 228/135

(58) Field of Classification Search ..... 29/447, 29/521, 527.2, 889.22, 890.09, 890.129, 29/890.131, 890.142; 228/203, 135; 60/740
See application file for complete search history.

(56) References Cited

U.S. PATENT DOCUMENTS

| | | | | |
|---|---|---|---|---|
| 1,875,457 | A | 9/1932 | Hemmingsen | |
| 5,439,257 | A * | 8/1995 | Williamson | 285/288.1 |
| 5,570,580 | A | 11/1996 | Mains | |
| 6,009,616 | A * | 1/2000 | Gellert | 29/611 |
| 6,321,541 | B1 | 11/2001 | Wrubel et al. | |
| 6,523,350 | B1 | 2/2003 | Mancini et al. | |
| 6,547,163 | B1 | 4/2003 | Mansour et al. | |
| 6,672,066 | B2 | 1/2004 | Wrubel et al. | |
| 6,688,534 | B2 | 2/2004 | Bretz | |
| 6,718,770 | B2 | 4/2004 | Laing et al. | |
| 6,824,082 | B2 * | 11/2004 | Ricco et al. | 239/533.3 |
| 7,399,942 | B2 * | 7/2008 | Wang et al. | 219/93 |
| 7,451,906 | B2 * | 11/2008 | Kisielius et al. | 228/56.3 |
| 7,515,781 | B2 * | 4/2009 | Chimenti et al. | 385/12 |
| 2003/0221429 | A1 | 12/2003 | Laing et al. | |
| 2004/0148937 | A1 | 8/2004 | Mancini | |

(Continued)

FOREIGN PATENT DOCUMENTS

| | | |
|---|---|---|
| DE | 4023222 | 9/1991 |

(Continued)

OTHER PUBLICATIONS

UK Search report dated May 23, 2007.
UK Search Report dated Mar. 13, 2009 for GB0821343.1.

*Primary Examiner* — David P Bryant
*Assistant Examiner* — Alexander P Taousakis
(74) *Attorney, Agent, or Firm* — Scott D. Wofsy; Edwards Angell Palmer & Dodge LLP

(57) ABSTRACT

A method of assembling a fuel nozzle includes providing a first nozzle component and a second nozzle component, wherein the first nozzle component is configured and adapted to engage within the second nozzle component. Braze is applied to at least one of the first and second nozzle components. The first nozzle component is assembled into the second nozzle component to provide a diametral interference fit therebetween. The method further includes joining the first and second nozzle components together. A fuel nozzle includes a first cylindrical nozzle component, a second cylindrical nozzle component disposed with an interference fit on an outward surface of the first nozzle component, and a layer of braze joiningly disposed between the first and second nozzle components.

16 Claims, 3 Drawing Sheets

U.S. PATENT DOCUMENTS

| | | | | |
|---|---|---|---|---|
| 2004/0148938 | A1 | 8/2004 | Mancini et al. | |
| 2007/0163263 | A1 | 7/2007 | Thomson | |
| 2009/0202858 | A1* | 8/2009 | Herber et al. | 428/637 |
| 2009/0277579 | A1* | 11/2009 | Marelli et al. | 156/293 |

FOREIGN PATENT DOCUMENTS

| | | |
|---|---|---|
| EP | 1750056 | 2/2007 |
| GB | 2374406 | 10/2002 |
| GB | 2404976 | 2/2005 |

* cited by examiner

Fig. 1
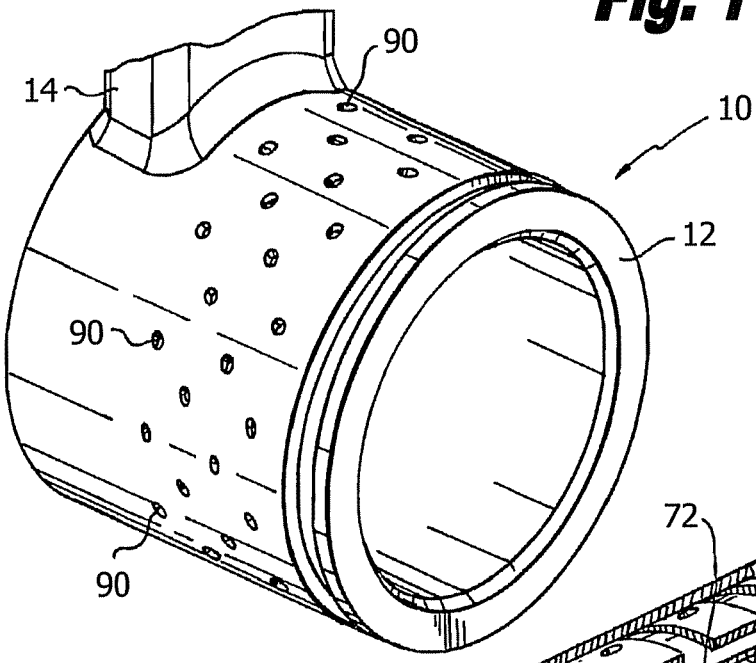
Fig. 2
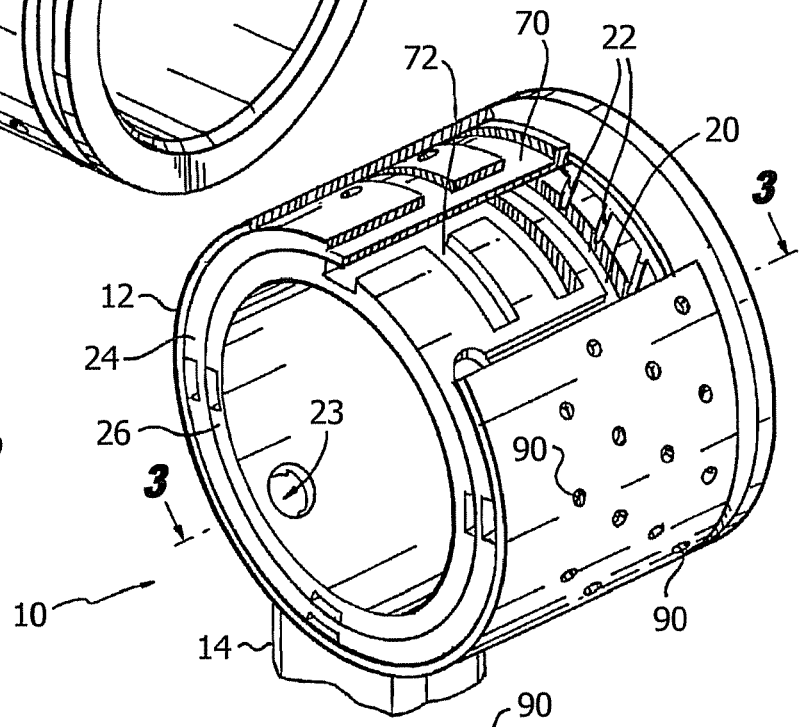
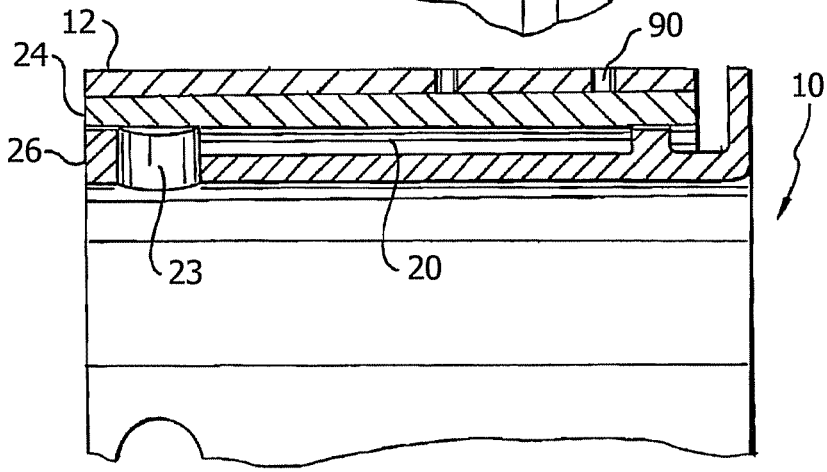
Fig. 3

METHOD OF FUEL NOZZLE CONSTRUCTION

BACKGROUND OF THE INVENTION

1. Field of the Invention

The subject invention is directed to fuel injection nozzles for gas turbine engines, and more particularly, to a system and method for assembling components of fuel nozzles.

2. Background of the Related Art

Staged fuel injectors for gas turbine engines are well know in the art. They typically include a pilot fuel atomizer for use during engine ignition and low power engine operation and at least one main fuel atomizer for use during high power engine operation in concert with the pilot fuel atomizer. One difficulty associated with operating a staged fuel injector is that when the pilot fuel circuit is operating alone during low power operation, stagnant fuel located within the main fuel circuit can be susceptible to carbon formation or coking due to the temperatures associated with the operating environment. This can degrade engine performance over time.

In the past, attempts were made to passively insulate or otherwise protect the main fuel circuit of a staged fuel injector from carbon formation during low power engine operation using heat shields or vents. Efforts have also been made to actively cool a staged fuel injector using fuel flow from the pilot fuel circuit. One such effort is disclosed in U.S. Pat. No. 5,570,580 to Mains, which provides a fuel injector having two dual orifice injector tips, each with a primary and secondary pressure atomizer. There, fuel streams to the primary and secondary sprays of the secondary and main nozzle tips are arranged to transfer heat therebetween.

U.S. Patent Application Publication No. 2007/0163263 to Thomson, which is incorporated by reference herein in its entirety, describes an advance in the art of protecting the main fuel circuit of a staged fuel injector from carbon formation. A staged fuel injector includes a main fuel circuit for delivering fuel to a main fuel atomizer and a pilot fuel circuit for delivering fuel to a pilot fuel atomizer located radially inward of the main fuel atomizer. The pilot fuel circuit is in close proximity to the main fuel circuit en route to the pilot fuel atomizer so that the pilot fuel flow cools stagnant fuel located within the main fuel circuit during low engine power operation to prevent coking.

Conventional construction of such fuel injectors, nozzles, and atomizers includes components bonded together by braze. The components have milled slots or drilled holes to control the flow of fuel and prepare the fuel for atomization. The components are typically nested within one another and form a narrow diametral gap which is filled with a braze alloy. The braze alloy is applied as a braze paste, wire ring, or as a thin sheet shim on the external surfaces or within pockets inside the assembly. The assembly is then heated and the braze alloy melts and flows into the narrow diametral gap and securely bonds the components together upon cooling.

Such conventional methods and systems generally have been considered satisfactory for their intended purpose. However, when using traditional brazing techniques, the braze alloy must flow from a ring or pocket to the braze area. In doing so, it is prone to flow imprecisely when melted. It is also not uncommon for braze fillets to be formed on or in certain features. In some instances intricate or narrow passages can become plugged if too much braze is used. These fillets and plugs can negatively affect nozzle performance. Moreover, braze may not flow to the desired braze area in the quantity needed to ensure a proper braze joint. This is typical when the braze alloy cannot be located in close proximity to the desired braze joint location.

The difficulty in controlling braze flow employing traditional brazing techniques is a limiting factor in the design of fuel and air flow passages within a nozzle. That is, the shape and size of the flow passages is limited by the ability to control the flow of braze.

There remains a need in the art for a method and system of assembling nozzles by brazing that will eliminate or greatly reduce fillet formation and/or plugging and allow for formation of intricate internal fuel and air flow passages. There also remains a need in the art for such a method and system that are easy and inexpensive to make and use. The present invention provides a solution for these problems.

SUMMARY OF THE INVENTION

The subject invention is directed to a method of assembling a fuel nozzle. The method includes providing a first radially inner nozzle component having inner and outer diametral surfaces and a second radially outer nozzle component having inner and outer diametral surfaces. The first nozzle component is configured for engagement within the second nozzle component with a diametral interference fit. The method further includes the step of applying braze to at least one of the radially outer diametral surface of the first nozzle component and the radially inner diametral surface of the second nozzle component. At least one of the first and second nozzle components is thermally resized to facilitate engagement of the first nozzle component within the second nozzle component, and the first and second nozzle components are joined together.

The step of applying braze can include coating the first nozzle component. It is also possible for the step of applying braze to include coating the second nozzle component. Moreover, the step of applying braze can include coating the outer diametral surface of the first nozzle component and coating the inner diametral surface of the second nozzle component.

Application of braze can include applying an electroless nickel coating or deposit that includes materials selected from a group consisting of: nickel, nickel-phosphorus, nickel-boron, nickel-boron-thallium, and/or any other suitable material. It is also possible to apply braze by a process selected from a group including electroless plating, electroplating, thermal spray, sputtering, physical vapor deposition, or any other suitable process. Depending on the process used, it is possible for the braze to include gold-nickel, gold-nickel-platinum, or any other suitable material. Moreover, braze can be applied as a deposit with a thickness between about 0.0002 inches and about 0.001 inches.

The step of thermally resizing can include thermally contracting the first nozzle component. It is possible to thermally contract the first nozzle component by application of liquid nitrogen, or by any other suitable means. The step of thermally resizing can include thermally expanding the second nozzle component, such as by application of a heated airflow, or by any other suitable means.

The step of joining includes applying a standard vacuum braze cycle to the braze, or any other suitable process. The step of joining can include utilizing interference fitting of the first and second nozzle components to prevent formation of eutectic phases in the braze.

The invention also includes a method of assembling a fuel nozzle including steps of providing a first nozzle component and a second nozzle component. The first nozzle component is configured and adapted to engage within the second nozzle component. The method further includes applying braze to at least one of the first and second nozzle components, assembling the first nozzle component within the second nozzle component to provide a diametral interference fit therebetween, and joining the first and second nozzle components together. It is contemplated that the step of assembling can include at least one process selected from among the following: pressing the first and second nozzle components together, thermally resizing at least one of the first and second nozzle components, plastically deforming at least one of the first and second nozzle components, or any other suitable process.

The subject invention is also directed to a new and useful fuel nozzle that includes a first cylindrical nozzle component, and a second cylindrical nozzle component disposed with an interference fit on an outward surface of the first nozzle component. The fuel nozzle includes a layer of braze joiningly disposed between the first and second nozzle components.

At least one of the first and second nozzle components can be annealed to at least partially relax the interference fit. The fuel nozzle can further include at least one fluid passage defined between the first and second nozzle components, wherein the fluid passage is substantially free from blockages by excess braze material. The fuel nozzle can further include a plurality of fluid passages defined between the first and second nozzle components, such that the layer of braze seals the multiple fluid passages from one another and wherein the fluid passages are free from blockages by excess braze material. At least one of the fluid passages can be a heat shield pocket. It is also contemplated that the layer of braze can have a thickness between about 0.0002 inches and about 0.001 inches. Moreover, the first and second nozzle components can be configured and adapted to be part of a nozzle of a type selected from a group including: pressure atomized, air blast, discrete jet, or any other suitable configuration.

These and other features of the fuel nozzle and methods of assembling a fuel nozzle of the subject invention will become more readily apparent to those skilled in the art from the following detailed description of the preferred embodiment taken in conjunction with the drawings.

BRIEF DESCRIPTION OF THE DRAWINGS

So that those skilled in the art to which the subject invention appertains will readily understand how to make and use the fuel nozzle of the subject invention without undue experimentation, preferred embodiments thereof will be described in detail hereinbelow with reference to certain figures, wherein:

FIG. 1 is a perspective view of a portion of a fuel injector nozzle constructed in accordance with a preferred embodiment of the subject invention;

FIG. 2 is a perspective view of the fuel injector nozzle of FIG. 1 inverted and viewed from the rear and shown in partial cross section to reveal internal flow passages on the bottom of the nozzle body defined in the radially inner and outer components;

FIG. 3 is a cross-sectional view taken along line 3-3 of FIG. 2, showing an internal air passage within the nozzle body.

DETAILED DESCRIPTION OF THE PREFERRED EMBODIMENTS

Figure 4A:
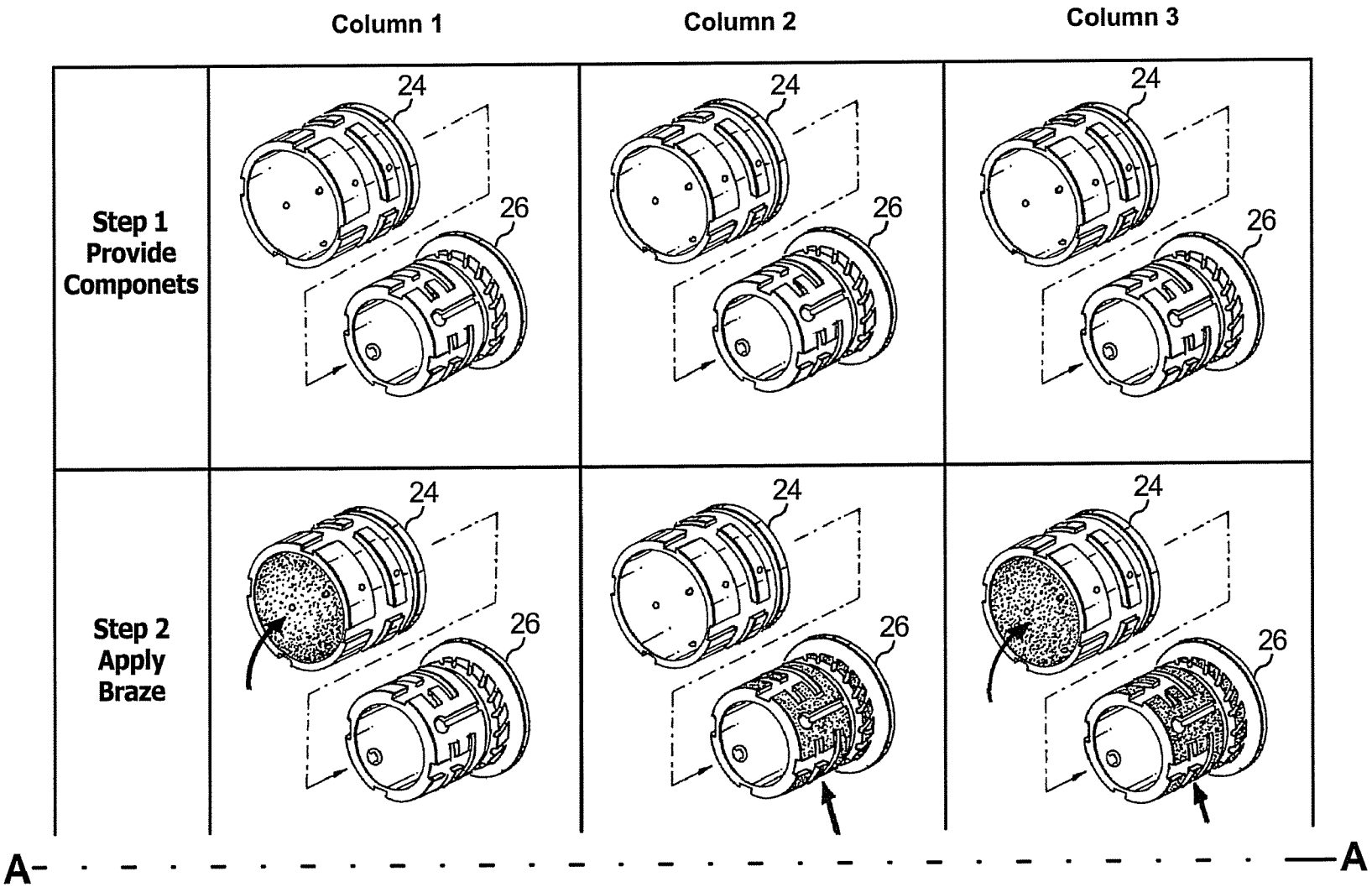
FIGS. 4*a*-4*b* depict a chart illustrating the steps in a method of joining fuel injector nozzle components in accordance with the subject invention, and more particularly, showing three different exemplary variations of the method.

Reference will now be made to the drawings wherein like reference numerals identify similar structural features or aspects of the subject invention. In accordance with the invention, a fuel nozzle includes a first cylindrical nozzle component, a second cylindrical nozzle component disposed with an interference fit on an outward surface of the first nozzle component, and a layer of braze joiningly disposed between the first and second nozzle components. For purposes of example and not limitation, there is illustrated in FIG. 1 a portion of a fuel injector nozzle constructed in accordance with a preferred embodiment of the subject invention and designated generally by reference numeral 10. Fuel injector 10 is adapted and configured for delivering fuel to the combustion chamber of a gas turbine engine.

Referring to FIG. 2, fuel injector 10 is generally referred to as a staged fuel injector in that it includes a primary, or pilot fuel circuit 72, which typically operates during engine ignition and at low engine power, and a secondary, or main fuel circuit 70, which typically operates at high engine power (e.g., at take-off and cruise) and is typically staged off at lower power operation.

With continuing reference to FIG. 2, fuel injector 10 includes a generally cylindrical nozzle body 12, which depends from an elongated feed arm 14. In operation, primary and secondary fuel is delivered into nozzle body 12 through concentric fuel feed tubes within feed arm 14. A plurality of secondary orifices 90 communicate through nozzle body 12 to allow fuel outside nozzle body 12 to communicate into fuel circuits 70/72. Typically the pilot fuel and main fuel are directed into separate fuel/air locations within a nozzle.

At the same time fuel is delivered to nozzle body 12 through feed arm 14, pressurized combustor air is directed into the rear end of nozzle body 12 through air inlets 23 and directed through a series of air circuits or passages 20. The air flowing through the air circuits interacts with the primary and secondary fuel flows from feed arm 14. That interaction facilitates the atomization of the primary and secondary fuel issued from the forward end of nozzle body 12 and into the combustion chamber of the gas turbine engine, and helps to cool the downstream end of the nozzle exposed to the combustion gasses. Swirl vanes 22 are provided within air circuit 20, to impart an angular component of swirl to the pressurized combustor air flowing therethrough. While not depicted for sake of clarity, those skilled in the art will readily appreciate that nozzle body 12 can further include other typical nozzle components including an outer air cap, outer air swirlers, inner air swirlers, or any other suitable components.

Cylindrical nozzle component 24 is positioned radially inward of the nozzle body 12 and cylindrical nozzle component 26 is positioned radially inward of component 24. Portions of the primary and secondary fuel circuits are defined in the outer diametral surfaces of components 24, 26.

As best seen in FIGS. 2 and 3, the close proximity of the primary and secondary fuel circuits 70, 72 enables the primary fuel flow to cool the secondary fuel flow when the engine is operating at high power and fuel is flowing within both the primary and secondary fuel circuits. In essence, the secondary cooling channels act as a multi-pass (or counterflow) heat exchanger to improve secondary cooling effectiveness. Additionally, those skilled in the art will readily appreciate that additional passages can be included between various nozzle components to form heat shield pockets filled with air, vacuum, noble gasses, or other suitable insulation materials to reduce coking in the fuel passages without departing from the spirit and scope of the invention.

The fuel passages 70, 72 and air passages 20 can be very intricate and should be completely sealed from each other to assure proper operation of nozzle 10. These requirements make joining components 24, 26 difficult under traditional methods. Typical brazing techniques rely on capillary forces, etc., to provide a relatively uncontrolled flow of braze through the features of nozzles to the desired braze joint location. Thus, nozzles formed by traditional brazing techniques are prone to braze fillets and even braze blockages forming within fuel and air passages, as well as incomplete sealing of various internal passages from one another.

However, nozzle 10 is substantially free of braze fillets and blockages in fuel passages 70, 72 and air passages 20 because only a very small amount of braze is present between first and second nozzle components 24, 26. This is possible because first and second nozzle components 24, 26 have a diametral interference fit and thus are in a state tightly pressed against each other. Only a small amount of braze is required to seal the various passages from each other and form a joint between components 24, 26. The layer of braze between components 24, 26 can be as thin as between about 0.0002 inches and 0.001 inches. However, those skilled in the art will readily appreciate that any appropriate thickness of braze can be used without departing from the spirit and scope of the invention.

While various exemplary nozzle components are described above, those skilled in the art will readily appreciate that various modifications are possible. Moreover, the nozzle can be of various types including pressure atomized, air blast, discrete jet, or any other suitable nozzle or fuel injector type without departing from the spirit and scope of the invention.

A method for assembling a fuel nozzle is provided. The method includes steps of providing a first radially inner nozzle component having inner and outer diametral surfaces and a second radially outer nozzle component having inner and outer diametral surfaces. The first nozzle component is configured for engagement with the second nozzle component with a diametral interference fit. The method further includes applying braze to at least one of the radially outer diametral surface of the first nozzle component and the radially inner diametral surface of the second nozzle component. A step is included for thermally resizing at least one of the first and second nozzle components to facilitate engagement of the first nozzle component within the second nozzle component. The method also includes joining the first and second nozzle components together.

For purposes of illustration and not limitation, as embodied herein and as depicted in Step 1 of FIG. 4*a*, a first radially inner nozzle component (e.g. 26) is provided, which has inner and outer diametral surfaces. A second nozzle component (e.g. 24) is also provided having inner and outer diametral surfaces. The first nozzle component is configured for engagement within the second nozzle component with a diametral interference fit. Preferably, the interference fit exists when the components are at room temperature.

The method includes a step of applying braze to at least one of the first and second nozzle components, as shown in Step 2 of FIG. 4*a*. As indicated by the arrow in Column 1 of FIG. 4*a*, it is possible to apply braze to an inner surface of component 24. However, braze can be applied to the outer surface of component 26 (as indicated by the arrow in Column 2 of FIG. 4*a*), or to mating surfaces of both components (as indicated by the arrows in Column 3 of FIG. 4*a*).

In a preferred embodiment, braze is applied as a deposit to at least one of the components 24, 26. The braze deposit can be nickel, nickel-phosphorus, nickel-boron, nickel-boron-thallium, or any other suitable braze material that can be deposited by an electroless process to metallic components. In one preferred embodiment, electroless nickel with 4-13% phosphorus or 3.5-5% boron is used as braze. Very thin braze deposits are possible, which can be between about 0.0002 inches and 0.0005 inches or up to about 0.001 inches. However, any suitable thickness can be used as appropriate without departing from scope of the invention.

Components can be coated by any suitable process. By way of example and not limitation, a component can be coated by deposition through dipping in a hot bath of braze material, such as nickel and boron braze. Other processes include diffusion boronizing of nickel plating. Those skilled in the art will readily appreciate that electroplating, thermal spray, sputtering, physical vapor deposition, or any suitable coating process can be used without departing from the spirit and scope of the invention, as long as the coating acts as braze, sticks to the component for assembly, and has a controllable thickness. Moreover, depending on the process used to apply, coat, or plate braze to the components, a variety of braze materials can be used including nickel, nickel-phosphorus, nickel-boron, nickel-boron-thallium, gold-nickel, gold-nickel-platinum, or any other suitable material. Any excess braze present on non-conjoining surfaces typically alloys with the base component when it melts. Since the coating is typically very thin, as described above, excess braze on non-conjoining surfaces does not tend form significant fillets or blockages.

Components 24 and 26 are dimensioned to fit together with a diametral interference fit, preferably at room temperature. As depicted in Step 3 of FIG. 4*b*, the method further includes thermally resizing at least one of the first and second nozzle components to facilitate engagement of the first nozzle component within the second nozzle component. This step can include applying heat to the component 24, as indicated by heat transfer arrows in Column 1 of FIG. 4*b*. It is also possible to perform the thermal resizing step by cooling component 26, as indicated by heat transfer arrows in Column 2 of FIG. 4*b*, to contract it for assembly within component 24. As indicated by heat transfer arrows in Column 3 of FIG. 4*b*, it is also possible to both heat component 24 and cool component 26 to facilitate assembly. Those skilled in the art will readily appreciate that regardless of which component(s) are coated, any of the thermal resizing methods shown in Columns 1-3 of FIG. 4*b* can be used without departing from the spirit and scope of the invention.

In a preferred embodiment, liquid nitrogen is applied to cool and contract component 26 and a flow of heated air is used to thermally expand component 24. However, those skilled in the art will readily appreciate that regardless of whether one or both components are thermally resized, any suitable means can be used to cause thermal expansion or contraction without departing from the spirit and scope of the invention.

Figure 4B:
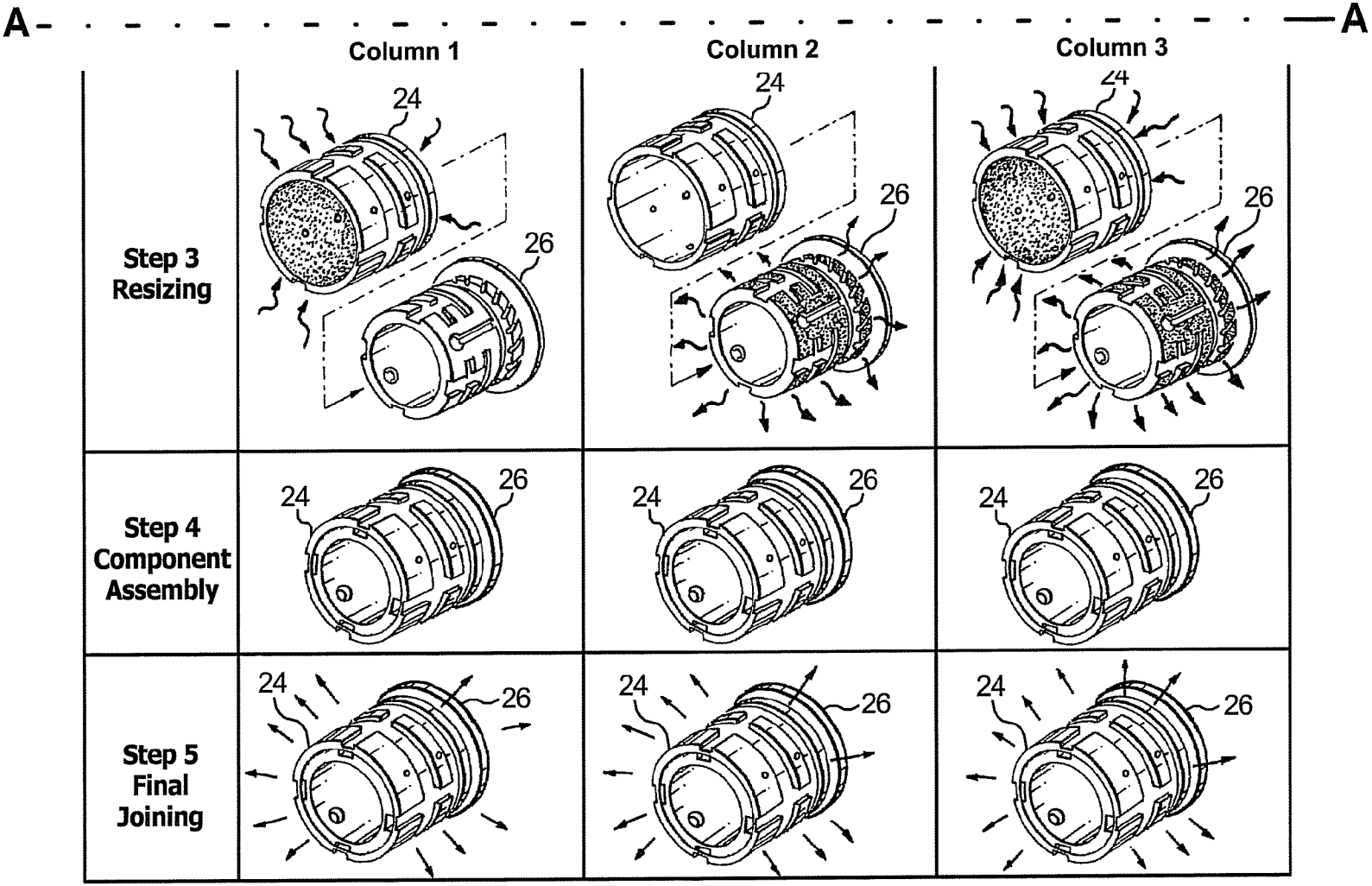

When thermally resized, components 24 and 26 are assembled, as indicated in Step 4 of FIG. 4*b*. The braze deposit can then be melted to join the two components. In a preferred embodiment, the two assembled components are subjected to a standard vacuum braze cycle to cause the braze deposit to bond therebetween, as indicated by arrows in Step 5 of FIG. 4*b*. However, those skilled in the art will readily appreciate that any suitable process can be used to cause the braze deposit to bond the components together without departing from the spirit and scope of the invention. When the braze has bonded the components together, it is possible to relieve stress from the interference fit by annealing, which can be at least partially accomplished during brazing itself.

While the examples provided above have been described using thermal resizing, it is also possible to use components having a diametral interference fit therebetween without thermal resizing. For example, it is possible to use a braze material of sufficient hardness as to allow two diametrically interfering components together to be pressed together without thermal resizing. The braze typically used provides a hard coat that is not scraped off of the components during the assembly. This technique is well suited for short braze engagement lengths and minimal interference. The resulting interference after assembly can be similar to that produced by the thermal resizing process.

It is also possible to use plated components having room temperature clearance and to create the interference fit after assembly by a forming operation on the outer diameter or inner diameter of one of the components. For example, during assembly of a three-component system (with outer, middle, and inner components), the outer two components can be thermally resized to fit together. The inner diameter of the middle component will be reduced by several thousands of an inch when the assembly temperature equilibrates. If the inner component is installed with a clearance fit prior temperature equilibration of the first two components, the reduction in diameter of the first two components can create diametral interference between the middle and inner components.

A similar result can be obtained by starting with two components that have a clearance fit at room temperature. If these components are thermally expanded together to accommodate a third, inner component, upon temperature equilibration an interference fit can result between the middle and inner components. The interference of the inner and middle components can cause the middle component to also have an interference fit with the outer component. In these cases, only the middle component needs a braze coating, since the middle component shares an interference fit with each of the other two components. Thus three components can be joined with only one braze coating step.

A further example uses two components with a clearance fit. One or both components can be plastically deformed to create a diametral interference fit. Those skilled in the art will readily appreciate that any other suitable way of providing an interference fit can be used without departing from the spirit and scope of the invention.

It is thus possible to join two or more nozzle components, as described above. It is possible, for example, for multiple components be thermally resized and joined in a single vacuum braze cycle step. It is presently preferred to begin with inner components and to proceed to outer components when thermally resizing. However any suitable order is possible. It is also possible for two components be brazed together as already described, and then additional components can be added to the assembled components by subsequent vacuum braze cycles, for example. It is also possible to join multiple components in any suitable order using processes without thermal resizing, as described above.

The interference fit between components 24, 26 prevents formation of eutectic phases in the braze during the joining process. This increases the durability of the braze joint. Nickel braze solidifies over a range of temperature that varies from the sides of the joint towards the middle. If boron is present, for example, it typically diffuses into the liquid braze at the center of the joint. If the joint is too wide, the last bit of liquid in the braze can solidify as NiB2, a brittle inter-metallic compound. In joints over 0.003 inches wide, these inter-metallic compounds are more likely to form. Joints are under about 0.0015 inches wide are small enough to discourage NiB2 and other inter-metallic compounds from forming. Interference fitting according to the invention further reduces the chances of formation of inter-metallic compounds in the joint.

This method allows for very intricate features such as injection points, fuel passages, air passages, insulation passages, etc., to be formed within injector nozzles without significant fillets and blockages resulting from brazing. This arises from the fact that only small amounts braze need be applied, as well as the fact that braze is applied directly to the joint location and does not need to flow from a ring or pocket to the braze area, as in traditional techniques. When braze is applied as a coating, the deposit thickness can be precisely controlled. The invention also allows for visual inspection prior to joining to verify braze is present in the location of the desired braze joint.

Other typical braze operations can be performed before, during, and/or after the steps described above to connect additional components. The assembly can also be welded, machined, and/or processed as any other assembly. For example, one component can include a standard gold-nickel braze. This component can be used during a nickel plating braze joining two or more components, as described above. The resulting assembly can also be welded, brazed again, and machined before being welded into a final nozzle assembly. Once interfering components have been assembled, further nozzle processing can be accomplished by known methods. Those skilled in the art will readily appreciate how to choose braze materials of differing melting temperatures so that subsequent brazing steps do not melt previously brazed joints.

With standard brazing methods, it is difficult to get braze to flow and seal a large number of individual passages in a nozzle, and braze volume can vary significantly. The invention allows for nozzle components that include multiple fuel or air passages that are sealed from one another by deposited braze. The complexity of injector structures is thus not limited by the brazing process under the methods and systems of the present invention. Therefore, ever more intricate and numerous injection points, cooling channels, air channels, fuel passages, heat shield pockets, swirlers, etc., are possible in accordance with the invention.

It is also possible to make the fuel nozzle significantly smaller in overall size and part count because ordinary construction methods require separate tubes for each fuel channel, multiple braze joints to separate the fuel channels, and thus more overall size and larger part count to make up an injector. Previous brazing techniques require large amounts of extra braze to guarantee full coverage of a complicated braze joint. The invention does not require extra braze or tubes for the joints to be sealed, and thus provides for smaller nozzles with lower part counts.

Tolerance requirements for components joined as described above are similar to standard braze joint tolerance requirements. A typical clearance for a standard braze joint in a nozzle is around 0.003 inches across a diameter. Nozzle components can readily joined by the processes described above if there is an interference of around 0.003 inches across a diameter. Therefore, the methods described herein provide many advantages without requiring tolerances beyond that of standard nozzle components.

While the systems and methods of the invention have been described above with exemplary components, those skilled in the art will appreciate various other suitable components or modifications within the scope of the invention. Additional fuel and air paths can be included, and additional nozzle components, swirlers, etc., can be joined to the first and second nozzle components described herein without departing from the spirit and scope of the invention.

The methods and systems of the present invention, as described above and shown in the drawings, provide for a fuel nozzle and method of assembling a fuel nozzle with superior properties including intricate fluid passages substantially free of braze fillets and blockages, and smaller minimum over all size and part count. While the apparatus and methods of subject invention have been shown and described with reference to preferred embodiments, those skilled in the art will readily appreciate that changes and/or modifications may be made thereto without departing from the spirit and scope of the subject invention.

What is claimed is:

1. A method of assembling a fuel nozzle, the method comprising steps of:

a) providing a first radially inner nozzle component having inner and outer diametral surfaces and a second radially outer nozzle component having inner and outer diametral surfaces, wherein the first nozzle component is configured for engagement within the second nozzle component with a diametral interference fit;

b) applying braze directly to a joint location of at least one of the radially outer diametral surface of the first nozzle component and the radially inner diametral surface of the second nozzle component;

c) thermally resizing at least one of the first and second nozzle components to facilitate engagement of the first nozzle component within the second nozzle component; and d) joining the first and second nozzle components together by engaging the first nozzle component within the second nozzle component with an interference fit with the braze pressed between the first and second nozzle components at the joint location, and by applying heat to the braze to form a braze joint at the joint location.

2. A method of assembling a fuel nozzle as recited in claim 1, wherein the step of applying braze includes coating the first nozzle component.

3. A method of assembling a fuel nozzle as recited in claim 1, wherein the step of applying braze includes coating the second nozzle component.

4. A method of assembling a fuel nozzle as recited in claim 1, wherein the step of applying braze includes coating the outer diametral surface of the first nozzle component and coating the inner diametral surface of the second nozzle component.

5. A method of assembling a fuel nozzle as recited in claim 1, wherein the step of applying braze includes applying an electroless nickel coating that includes materials selected from a group consisting of: nickel, nickel-phosphorus, nickel-boron, and nickel-boron-thallium.

6. A method of assembling a fuel nozzle as recited in claim 1, wherein the step of applying braze includes a process selected from a group consisting of: electroless plating, electroplating, thermal spray, sputtering, physical vapor deposition.

7. A method of assembling a fuel nozzle as recited in claim 1, wherein the step of applying braze includes applying a braze coating that includes materials selected from a group consisting of nickel, nickel-phosphorus, nickel-boron, nickel-boron-thallium, gold-nickel, and gold-nickel-platinum.

8. A method of assembling a fuel nozzle as recited in claim 1, wherein the step of applying braze includes applying braze as a deposit with a thickness between about 0.0002 inches and about 0.001 inches.

9. A method of assembling a fuel nozzle as recited in claim 1, wherein the step of thermally resizing includes thermally contracting the first nozzle component.

10. A method of assembling a fuel nozzle as recited in claim 9, wherein the step of thermally resizing includes thermally contracting the first nozzle component by application of liquid nitrogen.

11. A method of assembling a fuel nozzle as recited in claim 1, wherein the step of thermally resizing includes thermally expanding the second nozzle component.

12. A method of assembling a fuel nozzle as recited in claim 11, wherein the step of thermally resizing includes thermally expanding the second nozzle component by application of a heated airflow.

13. A method of assembling a fuel nozzle as recited in claim 1, wherein the step of joining includes applying a standard vacuum braze cycle to the braze.

14. A method of assembling a fuel nozzle as recited in claim 1, wherein the step of joining includes utilizing interference fitting of the first and second nozzle components to prevent formation of eutectic phases in the braze.

15. A method of assembling a fuel nozzle, the method comprising steps of:

a) providing a first nozzle component and a second nozzle component, wherein the first nozzle component is configured and adapted to engage within the second nozzle component;

b) applying braze directly to a joint location of at least one of the first and second nozzle components;

c) assembling the first nozzle component within the second nozzle component to provide a diametral interference fit therebetween with the braze pressed between the first and second nozzle components at the joint location; and d) joining the first and second nozzle components together to form a braze joint at the joint location.

16. A method of assembling a fuel nozzle as recited in claim 15, wherein the step of assembling includes at least one process selected from a group consisting of: pressing the first and second nozzle components together, thermally resizing at least one of the first and second nozzle components, and plastically deforming at least one of the first and second nozzle components.

* * * * *